United States Patent [19]

Spendel

[11] Patent Number: 4,959,125

[45] Date of Patent: Sep. 25, 1990

[54] SOFT TISSUE PAPER CONTAINING NONCATIONIC SURFACTANT

[75] Inventor: Wolfgang U. Spendel, Cincinnati, Ohio

[73] Assignee: The Procter & Gamble Company, Cincinnati, Ohio

[21] Appl. No.: 280,119

[22] Filed: Dec. 5, 1988

[51] Int. Cl.[5] ..... D21F 9/02; D21H 5/24

[52] U.S. Cl. ..... 162/158; 162/111; 162/112; 162/179

[58] Field of Search ..... 162/179, 111, 158, 175, 162/100, 101

[56] References Cited

U.S. PATENT DOCUMENTS

| | | | |
|---|---|---|---|
| 3,301,746 | 1/1967 | Sanford et al. | 162/113 |
| 3,755,220 | 8/1973 | Freimark et al. | 260/17.3 |
| 3,812,000 | 5/1974 | Salvucci, Jr. et al. | 162/111 |
| 3,821,068 | 6/1974 | Shaw | 162/111 |
| 3,844,880 | 10/1974 | Meisel, Jr. et al. | 162/169 |
| 3,974,025 | 8/1976 | Ayers | 162/113 |
| 3,994,771 | 11/1976 | Morgan, Jr. et al. | 162/113 |
| 4,011,389 | 3/1977 | Langdon | 162/175 X |
| 4,158,594 | 6/1968 | Becker et al. | 162/112 |
| 4,191,609 | 3/1980 | Trokhan | 162/113 |
| 4,300,981 | 11/1981 | Carstens | 162/109 |
| 4,447,294 | 5/1984 | Osborn | 162/158 |
| 4,488,932 | 12/1984 | Eber et al. | 162/100 X |
| 4,637,859 | 1/1987 | Trokhan | 162/109 |
| 4,737,582 | 4/1988 | Goldman et al. | 428/532 X |
| 4,755,178 | 7/1988 | Insley et al. | 210/511 X |
| 4,795,530 | 1/1989 | Soerens et al. | 162/111 |

OTHER PUBLICATIONS

"Applications of Armak Quaternary Ammonium Salts", Bulletin 76-17, Armak Co., (1977).

*Primary Examiner*—Peter Chin
*Assistant Examiner*—Thi Dang
*Attorney, Agent, or Firm*—Bart S. Hersko; Thomas J. Slone; Fredrick H. Braun

[57] ABSTRACT

Tissue paper having an enhanced tactile sense of softness through incorporation of an effective amount of a noncationic surfactant is disclosed. Preferably, less than about 2.0% of the noncationic surfactant, on a dry fiber weight basis, is incorporated in the tissue paper: more preferably, only about 1.0% or less is so retained. Tissue paper embodiments of the present invention may further contain a quantity of a binder material, such as starch, for linting control, and to increase paper strength.

5 Claims, No Drawings

SOFT TISSUE PAPER CONTAINING NONCATIONIC SURFACTANT

TECHNICAL FIELD

This invention relates, in general, to tissue paper; and more specifically, to high bulk tissue paper having an enhanced tactile sense of softness.

BACKGROUND OF THE INVENTION

Soft tissue paper is generally preferred for disposable paper towels, and facial and toilet tissues. However, known methods and means for enhancing softness of tissue paper generally adversely affect tensile strength. Tissue paper product design is, therefore, generally, an exercise in balancing softness against tensile strength.

Both mechanical and chemical means have been introduced in the pursuit of making soft tissue paper: tissue paper which is perceived by users, through their tactile sense, to be soft. A well known mechanical method of increasing tensile strength of paper made from cellulosic pulp is by mechanically refining the pulp prior to papermaking. In general, greater refining results in greater tensile strength. However, consistent with the foregoing discussion of tissue tensile strength and softness, increased mechanical refining of cellulosic pulp negatively impacts tissue paper softness, all other aspects of the papermaking furnish and process being unchanged.

A variety of chemical treatments have been proposed to increase the tactile sense of softness of tissue paper sheets For example, it was disclosed in German Patent No. 3,420,940, Kenji Hara et al, to dip, impregnate, or spray dry tissue paper with a combination of a vegetable, animal, or synthetic hydrocarbon oil and a silicone oil such as dimethylsilicone oil. Among other benefits, the silicone oil is said to impart a silky, soft feeling to the tissue paper. This tissue paper, contemplated for toilet paper applications, suffers from disposal complications when flushed through pipe and sewer systems in that the oils are hydrophobic and will cause the tissue paper to float, especially with the passage of time subsequent to treatment with the oils. Another disadvantage is high cost associated with the apparent high levels of the oils contemplated.

It has also been disclosed to treat tissue paper and the furnish used to make tissue paper with certain chemical debonding agents. For example, U.S. Pat. No. 3,844,880, Meisel Jr. et al, issued Oct. 29, 1974, teaches that the addition of a chemical debonding agent to the furnish prior to sheet formation leads to a softer sheet of tissue paper. The chemical debonding agents used in the Meisel Jr. et al process are preferably cationic. Other references, e.g., U.S. Pat. No. 4,158,594, Becker et al, issued Jan. 19, 1979 and Armak Company, of Chicago, Ill., in their bulletin 76-17 (1977) have proposed the application of cationic debonders subsequent to sheet formation. Unfortunately, cationic debonders in general have certain disadvantages associated with their use in tissue paper softening applications. In particular, some low molecular weight cationic debonders may cause excessive irritation upon contact with human skin. Higher molecular weight cationic debonders may be more difficult to apply in low levels to tissue paper, and also tend to have undesirable hydrophobic effects upon the tissue paper. Additionally, the cationic debonder treatments of these references tend to decrease tensile strength to such an extent that the use of substantial levels of resins, latex, or other dry strength additives is required to provide commercially acceptable levels of tensile strength. Such dry strength additives add substantial raw materials cost to the tissue paper due to the relatively high level of additive required to provide sufficient dry strength. Furthermore, many dry strength additives have a deleterious affect on tissue softness.

It has now been discovered that treating tissue with a noncationic surfactant results in significant improvement in the tissue paper's tensile/softness relationship relative to traditional methods of increasing softness. That is, the noncationic surfactant treatment of the present invention greatly enhances tissue softness, and any accompanying decrease in tensile strength can be offset by traditional methods of increasing tensile strength such as increased mechanical refining. It has further been discovered that the addition of an effective amount of a binder, such as starch, will at least partially offset any reduction in tensile strength and/or increase in linting propensity that results from the noncationic surfactant.

While the present invention relates to improving the softness of paper in general, it pertains in particular to improving the tactile perceivable softness of high bulk, creped tissue paper. Representative high bulk, creped tissue papers which are quite soft by contemporary standards, and which are susceptible to softness enhancement through the present invention are disclosed in the following U.S. Pat. Nos.: 3,301,746, Sanford and Sisson, issued Jan. 31, 1967; 3,974,025, Ayers, issued Aug. 10, 1976; 3,994,771 Morgan Jr. et al, issued Nov. 30, 1976; 4,191,609, Trokhan, issued Mar. 4, 1980 and 4,637,859, Trokhan; issued Jan. 20, 1987. Each of these papers is characterized by a pattern of dense areas: areas more dense than their respective remainders, such dense areas resulting from being compacted during papermaking as by the crossover knuckles of imprinting carrier fabrics. Other high bulk, soft tissue papers are disclosed in U.S. Pat. No. 4,300,981, Carstens, issued Nov. 17, 1981; and 4,440,597, Wells et al, issued Apr. 3, 1984. Additionally, achieving high bulk tissue paper through the avoidance of overall compaction prior to final drying is disclosed in U.S. Pat. No. 3,821,068, Shaw, issued June 28, 1974; and avoidance of overall compaction in combination with the use of debonders and elastomeric bonders in the papermaking furnish is disclosed in U.S. Pat. No. 3,812,000, Salvucci Jr., issued May 21, 1974.

It is an object of this invention to provide tissue paper which has an enhanced tactile sense of softness.

It is a further object of this invention to provide tissue paper which has increased tactile softness at a particular level of tensile strength relative to tissue paper which has been softened by conventional techniques.

These and other objects are obtained using the present invention, as will be seen from the following disclosure.

SUMMARY OF THE INVENTION

In one aspect of the invention, tissue paper is provided having a basis weight of from about 10 to about 65 g/m$^2$, fiber density of about 0.6 g/cc or less, and which comprises an effective amount of a noncationic surfactant additive to effect enhanced softness. The noncationic surfactant is, preferably, applied to a wet tissue web. Preferably, the tissue paper comprises from about 0.01% to about 2 percent of the noncationic surfactant additive, based on the dry fiber weight of the tissue paper; and, more preferably, the amount of such an additive is from about 0.05 to about 1.0 percent. An especially unexpected benefit of the noncationic surfactant treatment of the tissue paper at the preferred noncationic surfactant levels discussed above, is the high level of tactile softness, at a given tensile strength, relative to conventional methods for increasing softness, such as decreasing the level of mechanical refining. That is, the addition of the noncationic surfactant makes it possible to provide soft tissue paper at the desired tensile strength by, for example, maintaining or increasing the level of mechanical refining.

Noncationic surfactants which are suitable for use in the present invention include anionic, nonionic, ampholytic and zwitterionic surfactants. Preferably, the noncationic surfactant is a nonionic surfactant, with nonionic alkylglycosides being especially preferred. Also, preferably, the surfactant is substantially nonmigratory in situ after the tissue paper has been manufactured in order to substantially obviate post-manufacturing changes in the tissue paper's properties which might otherwise result from the inclusion of surfactant. This may be achieved, for instance, through the use of noncationic surfactants having melt temperatures greater than the temperatures commonly encountered during storage, shipping, merchandising, and use of tissue paper product embodiments of the invention: for example, melt temperatures of about 50° C. or higher.

Tissue paper comprising a noncationic surfactant in accordance with the present invention may further comprise an effective amount of a binder material such as starch to offset any increase in linting propensity or reduction of tensile strength, which would otherwise result from the incorporation of the surfactant material. Preferably, the binder material is added to a wet tissue web. Surprisingly, it has been found that surface treatment of tissue paper with a noncationic surfactant and starch mixture results in tissue which is softer for a given tensile strength than tissue which has been treated with noncationic surfactant alone. The effective amount of binder material is preferably from about 0.01 to about 2 percent on a dry fiber weight basis of the tissue paper.

A particularly preferred tissue paper embodiment of the present invention comprises from about 0.05 to about 1.0 percent of a nonionic surfactant material; and from about 0.1 to about 1.0 percent starch, all quantities of these additives being on a dry fiber weight basis of the tissue paper.

The present invention is described in more detail below.

DETAILED DESCRIPTION OF THE INVENTION

Briefly, the present invention provides tissue paper having an enhanced softness through the incorporation of a noncationic surfactant additive. Any reduction in tensile strength of the tissue paper resulting from the addition of the noncationic surfactant can be offset by conventional methods of increasing tensile strength, such as increased mechanical refining, thereby yielding a softer paper at a given tensile strength. Such tissue paper may further include an effective amount of a binder material such as starch to offset any exacerbation of linting propensity and/or reduction of tissue paper tensile strength which may be precipitated by the addition of the noncationic surfactant. Surprisingly, the combination of surfactant and starch treatments has been found to provide greater softness benefits for a given tensile strength level than the softness benefits obtained by treatment with the noncationic surfactant alone. This is totally unexpected because the isolated effect of the binder treatment is to increase strength and consequently decrease softness of the tissue paper.

While not wishing to be bound by a theory of operation or to otherwise limit the present invention, tissue paper embodiments of the present invention are generally characterized as being within a tri-parametric domain defined by empirically determined ranges of the following parameters: first, the ratio of their Total Flexibility to their Total Strength; second, their Physiological Surface Smoothness; and third, their Slip-And-Stick Coefficient of Friction. For example, tests conducted in accordance with the following procedures defined by the present invention's tri-parametric domain as: a ratio of Total Flexibility to Total Tensile Strength of about 0.13 or less; Physiological Surface Smoothness of about 0.95 or less; and a Slip-and-Stick Coefficient of Friction of about 0.033 or less for pattern densified tissue papers, and about 0.038 or less for tissue paper embodiments having substantially uniform densities. By way of contrast, all contemporary tissue papers which have been tested and which do not embody the present invention fell outside this tri-parametric domain. These parameters and tests are discussed below.

FLEXIBILITY and TOTAL FLEXIBILITY

Flexibility as used herein is defined as the slope of the secant of the graph-curve derived from force vs. stretch % data which secant passes through the origin (zero % stretch, zero force) and through the point on the graph-curve where the force per centimeter of width is 20 grams. For example, for a sample which stretches 10% (i.e., 0.1 cm/cm of length) with 20 grams of force per cm of sample width, the slope of the secant through (0%, 0) and (10%, 20) is 2.0 using the formula:

$$\text{Slope} = \frac{Y_2 - Y_1}{X_2 - X_1}$$

Total Flexibility as used herein means the geometric mean of the machine-direction flexibility and cross-machine-direction flexibility. Mathematically, this is the square root of the product of the machine-direction flexibility and cross-machine-direction flexibility in grams per cm.

TOTAL TENSILE STRENGTH

Total tensile strength as used herein means the geometric mean of the machine and cross-machine breaking strengths in grams per cm of sample width. Mathematically, this is the square root of the product of the machine and cross-machine direction breaking strengths in grams per cm of sample width.

WABY FACTOR

The ratio of Total Flexibility to Total Tensile Strength has been determined to be a factor which characterizes embodiments of the invention as being strong yet having high bulk softness. This ratio is hereby dubbed the WABY Factor.

$$\text{WABY Factor} = \frac{\text{Total Flexibility}}{\text{Total Tensile Strength}}$$

For instance, a sample having a Total Flexibility of 20 g/cm, and a Total Tensile Strength of 154 g/cm has a WABY Factor of 0.13.

Briefly, tactile perceivable softness of tissue paper is inversely related to its WABY Factor; and limited empirical data indicate that tissue paper embodiments of the present invention have WABY Factors of about 0.13 or less. Also, note that the WABY Factor is dimensionless because both Flexibility and Total Tensile Strength as defined above are in g/cm, their ratio is dimensionless.

PHYSIOLOGICAL SURFACE SMOOTHNESS

Physiological surface smoothness as used herein is a factor (hereinafter the PSS Factor) derived from scanning machine-direction tissue paper samples with a profilometer (described below) having a diamond stylus, the profilometer being installed in a surface test apparatus such as, for example, Surface Tester KES-FB-4 which is available from KATO TECH CO., LTD., Karato-Cho, Nishikiyo, Minami-Ku, Koyota, Japan. In this tester, a sample of tissue is mounted on a motorized drum, and a stylus is gravitationally biased towards the drum at the 12 o'clock position. The drum is rotated to provide a sample velocity of one (1) millimeter per second, and moves the sample 2 cm. with respect to the probe. Thus, the probe scans a 2 cm length of the sample. The profilometer comprises means for counterbalancing the stylus to provide a normal force of 270 mg. Basically, the instrument senses the up and down displacements (in mm) of the stylus as a 2 cm length of sample is scanned under the profilometer probe. The resulting stylus-amplitude vs. stylus-distance-scanned data are digitized, and then converted to a stylus-amplitude vs. frequency spectrum by performing a Fourier Transform using the Proc Spectra standard program available from SAS Institute Inc., Post Office Box 10066, Raleigh, N.C. 27605. This identifies spectral components in the sample's topography; and the frequency spectral data are then adjusted for human tactile responsiveness as quantified and reported by Verrillo (Ronald T. Verrillo, "Effect of Contractor Area on the Vibrotactile Threshold", The Journal of the Accoustical Society of America, 35, 1962 (1963)). However, whereas Verrillo's data are in the time domain (i.e., cycles per second), and physiological surface smoothness is related to finger-to-sample velocity, Verrillo-type data are converted to a spatial domain (i.e., cycles per millimeter) using 65 mm/sec as a standard finger-to-sample velocity factor. Finally, the data are integrated from zero (0) to ten (10) cycles per millimeter. The result is the PSS Factor. Graphically, the PSS Factor is the area under the Verrillo-adjusted frequency (cycles/mm) vs. stylus amplitude curve between zero (0) and ten (10) cycles per millimeter. Preferably, PSS Factors are average values derived from scanning multiple samples (e.g., ten samples), both forward and backward.

The profilometer described above comprises, more specifically, a Gould Surfanalyzer Equipment Controller #21-1330-20428, Probe #21-3100-465, Diamond stylus tip (0.0127 mm radius) #21-0120-00 and stylus tip extender #22-0129-00 all available from Federal Products, Providence, R.I. The profilometer probe assembly is fitted with a counterbalance, and set up as depicted in FIG. 22 of U.S. Pat. No. 4,300,981 (referenced hereinbefore).

SLIP-AND-STICK COEFFICIENT OF FRICTION

Slip-and-stick coefficient of friction (hereinafter S&S COF) is defined as the mean deviation of the coefficient of friction. It is dimensionless. It may be determined using commercially available test apparatus such as, for example, the Kato Surface Tester identified above which has been fitted with a stylus which is configured and disposed to slide on the surface of the sample being scanned: i.e., a fritted glass disk. When a sample is scanned as described above, the instrument senses the lateral force on the stylus as the sample is moved thereunder: i.e., scanned. The lateral force is called the frictional force; and the ratio of frictional force to stylus weight is the coefficient of friction, mu. The instrument then solves the following equation to determine S&S COF for each scan of each sample.

$$S\&S\ COF = \frac{S_o^x |\mu - \bar{\mu}| dx}{S_o^x dx}$$

in which $\mu$ is the ratio of frictional force to probe loading;

$\bar{\mu}$ is the average value of $\mu$; and

X is 2 cm.

Returning now to the Detailed Description of The Invention, the present invention—noncationic surfactant treated tissue papers having enhanced tactile responsiveness—includes but is not limited to: conventionally felt-pressed tissue paper; pattern densified tissue paper such as exemplified by Sanford-Sisson and its progeny; and high bulk, uncompacted tissue paper such as exemplified by Salvucci. The tissue paper may be of a homogenous or multilayered construction; and tissue paper products made therefrom may be of a single-ply or multi-ply construction. The tissue paper preferably has a basis weight of between about 10 g/m$^2$ and about 65 g/m$^2$, and density of about 0.60 g/cc or less. Preferably, basis weight will be below about 35 g/m$^2$ or less; and density will be about 0.30 g/cc or less. Most preferably, density will be between about 0.04 g/cc and about 0.20 g/cc.

Papermaking fibers which may be utilized for the present invention include fibers derived from wood pulp. Other cellulosic fibrous pulp fibers, such as cotton linters, bagasse, etc., can be utilized and are intended to be within the scope of this invention. Synthetic fibers, such as rayon, polyethylene and polypropylene fibers, may also be utilized in combination with natural cellulosic fibers. One exemplary polyethylene fiber which may be utilized is Pulpex TM, available from Hercules, Inc. (Wilmington, Del.).

Applicable wood pulps include chemical pulps made by the Kraft, sulfite, and sulfate processes; and mechanical pulps including, for example, groundwood, thermomechanical pulp and chemically modified thermomechanical pulp. Chemical pulps, however, are preferred since they impart a superior tactile perceivable softness to tissue sheets made therefrom. Pulps may be utilized which are derived from both deciduous trees which are sometimes referred to as "hardwood"; and coniferous trees which are sometimes referred to as "softwood".

In addition to papermaking fibers, the papermaking furnish used to make tissue paper structures may have other components or materials added thereto: for example, wet-strength and temporary wet-strength resins.

Types of noncationic surfactants which are suitable for use in the present invention include anionic, nonionic, ampholytic, and zwitterionic surfactants. Mixtures of these surfactants can also be used. As used herein the term noncationic surfactants shall include all of such types of surfactants. The preferred noncationic surfactants are anionic and nonionic surfactants, with nonionic surfactants being most preferred. The noncationic surfactants preferably have alkyl chains containing eight or more carbon atoms.

A. Nonionic Surfactants

Suitable nonionic surfactants are generally disclosed in U.S. Pat. No. 3,929,678, Laughlin et al, issued Dec. 30, 1975, at column 13, line 14 through column 16, line 6, incorporated herein by reference. Classes of useful nonionic surfactants include:

The condensation products of alkyl phenols with ethylene oxide. These compounds include the condensation products of alkyl phenols having an alkyl group containing from about 8 to about 12 carbon atoms in either a straight chain or branched chain configuration with ethylene oxide, the ethylene oxide being present in an amount equal to from about 5 to about 25 moles of ethylene oxide per mole of alkyl phenol. Examples of compounds of this type include nonyl phenol condensed with about 9.5 moles of ethylene oxide per mole of phenol; dodecyl phenol condensed with about 12 moles of ethylene oxide per mole of phenol; dinonyl phenol condensed with about 15 moles of ethylene oxide per mole of phenol; and diisooctyl phenol condensed with about 15 moles of ethylene oxide per mole of phenol. commercially available nonionic surfactants of this type include Igepal CO-630, marketed by the GAF Corporation; and Triton X-45, X-114, X-100, and X-102, all marketed by the Rohm & Haas Company.

2. The condensation products of aliphatic alcohols with from about 1 to about 25 moles of ethylene oxide. The alkyl chain of the aliphatic alcohol can either be straight or branched, primary or secondary, and generally contains from about 8 to about 22 carbon atoms. Particularly preferred are the condensation products of alcohols having an alkyl group containing from about 10 to about 20 carbon atoms with from about 4 to abut 10 moles of ethylene oxide per mole of alcohol. Examples of such ethoxylated alcohols include the condensation product of myristyl alcohol with about 10 moles of ethylene oxide per mole of alcohol; and the condensation product of coconut alcohol (a mixture of fatty alcohols with alkyl chains varying in length from 10 to 14 carbon atoms) with about 9 moles of ethylene oxide. Examples of commercially available nonionic surfactants of this type include Tergitol 15-S-9 (the condensation product of $C_{11}$–$C_{15}$ linear alcohol with 9 moles ethylene oxide), marketed by Union Carbide Corporation; Neodol 45-9 (the condensation product of $C_{14}$–$C_{15}$ linear alcohol with 9 moles of ethylene oxide), Neodol 23-6.5 (the condensation product of $C_{12}$–$C_{13}$ linear alcohol with 6.5 moles of ethylene oxide), Neodol 45-7 (the condensation product of $C_{14}$–$C_{15}$ linear alcohol with 7 moles of ethylene oxide), Neodol 45-4 (the condensation product of $C_{14}$–$C_{15}$ linear alcohol with 4 moles of ethylene oxide), marketed by Shell Chemical Company, and Kyro EOB (the condensation product of $C_{13}$–$C_{15}$ linear alcohol with 9 moles ethylene oxide), marketed by The Procter & Gamble Company.

3. The condensation products of ethylene oxide with a hydrophobic base formed by the condensation of propylene oxide with propylene glycol. The hydrophobic portion of these compounds has a molecular weight of from about 1500 to about 1800 and exhibits water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation with up to about 40 moles of ethylene oxide. Examples of compounds of this type include certain of the commercially available Pluronic surfactants, marketed by Wyandotte Chemical Corporation.

4. The condensation products of ethylene oxide with the product resulting from the reaction of propylene oxide and ethylenediamine. The hydrophobic moiety of these products consists of the reaction product of ethylenediamine and excess propylene oxide, and generally has a molecular weight of from about 2500 to about 3000. This hydrophobic moiety is condensed with ethylene oxide to the extent that the condensation product contains from about 40% to about 80% by weight of polyoxyethylene and has a molecular weight of from about 5,000 to about 11,000. Examples of this type of nonionic surfactant include certain of the commercially available Tetronic compounds, marketed by Wyandotte Chemical Corporation.

5. Semi-polar nonionic surfactants, which include water-soluble amine oxides containing one alkyl moiety of from about 10 to about 18 carbon atoms and 2 moieties selected from the group consisting of alkyl groups and hydroxyalkyl groups containing from about 1 to about 3 carbon atoms; water-soluble phosphine oxides containing one alkyl moiety of from about 10 to about 18 carbon atoms and 2 moieties selected from the group consisting of alkyl groups and hydroxyalkyl groups containing from about 1 to about 3 carbon atoms; and water-soluble sulfoxides containing one alkyl moiety of from about 10 to 18 carbon atoms and a moiety selected from the group consisting of alkyl and hydroxyalkyl moieties of from about 1 to 3 carbon atoms.

Preferred semi-polar nonionic surfactants are the amine oxide surfactants having the formula $$R^3(OH^4)_xNR^5{}_2 \rightarrow O$$

wherein $R^3$ is an alkyl, hydroxyalkyl, or alkyl phenyl group or mixtures thereof containing from about 8 to about 22 carbon atoms; $R^4$ is an alkylene or hydroxyalkylene group containing from about 2 to about 3 carbon atoms or mixtures thereof; x is from 0 to about 3; and each $R^5$ is an alkyl or hydroxyalkyl group containing from about 1 to about 3 carbon atoms or a polyethylene oxide group containing from about 1 to about 3 ethylene oxide groups. The $R^5$ groups can be attached to each other, e.g., through an oxygen or nitrogen atom, to form a ring structure.

Preferred amine oxide surfactants are $C_{10}$–$C_{18}$ alkyl dimethyl amine oxides and $C_8$–$C_{12}$ alkoxy ethyl dihydroxy ethyl amine oxides.

6. Alkylpolysaccharides disclosed in U.S. Pat. No. 4,565,647, Llenado, issued Jan. 21, 1986, having a hydrophobic group containing from about 6 to about 30 atoms, preferably from about 10 to about 16 carbon atoms and a polysaccharide, e.g., a polyglycoside, hydrophilic group containing from about 1½ to about 10, preferably from about 1½ to about 3, most preferably from about 1.6 to about 2.7 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the 1-position of the additional saccharide units and the 2-, 3-, 4-, and/or 6-positions on the preceding saccharide units.

Optionally, and less desirably, there can be a polyalkyleneoxide chain joining the hydrophobic moiety and the polysaccharide moiety. The preferred alkyleneoxide is ethylene oxide. Typical hydrophobic groups include alkyl groups, either saturate or unsaturated, branched or unbranched containing from about 8 to about 18, preferably from about 10 to about 16, carbon atoms. Preferably, the alkyl group is a straight chain saturated alkyl group. The alkyl group can contain up to 3 hydroxy groups and/or the polyalkyleneoxide chain can contain up to about 10, preferably less than 5, alkyleneoxide moieties. Suitable alkyl polysaccharides are octyl, nonyldecyl, undecyldodecyl, tridecyl, tetradecyl, pentadecyl, hexadecyl, heptadecyl, and octadecyl, di-, tri-, tetra-, penta-, and hexaglucosides, galactusides, lactosides, glucoses, fructosides, fructoses and/or galactoses. Suitable mixtures include coconut alkyl, di-, tri-, tetra-, and pentaglucosides and tallow alkyl tetra-, penta-, and hexaglucosides.

Alkylpolyglycosides are particularly preferred for use in the present invention. The preferred alkylpolyglycosides have the formula $$R^2O(C_nH_{2n}O)_t(\text{glycosyl})_x$$

wherein $R^2$ is selected from the group consisting of alkyl, alkylphenyl, hydroxyalkyl, hydroxyalkylphenyl, and mixtures thereof in which the alkyl groups contain from about 10 to about 18, preferably from about 12 to about 14, carbon atoms; n is 2 or 3, preferably 2; t is from 0 to about 10, preferably 0; and x is from about 1½ to about 10, preferably from about 1½ to about 3, most preferably from about 1.6 to about 2.7. The glycosyl is preferably derived from glucose. To prepare these compounds, the alcohol or alkylpolyethoxy alcohol is formed first and then reacted with glucose, or a source of glucose, to form the glucoside (attachment at the 1-position). The additional glycosyl units can then be attached between their 1-position and the preceding glycosyl units 2-, 3-, 4- and/or 6-position, preferably predominately the 2-position.

Commercially available alkylglycosides include alkylglycoside polyesters such as Crodesta TM SL-40 which is available from Croda, Inc. (New York, N.Y.) and alkylglycoside polyethers as described in U.S. Pat. No. 4,011,389, issued to W. K. Langdon, et al, on Mar. 8, 1977. Alkylglycosides are additionally disclosed in U.S. Pat. No. 3,598,865, Lew, issued August 1971; U.S. Pat. No. 3,721,633, Ranauto, issued March 1973; U.S. Pat. No. 3,772,269, Lew, issued November 1973; U.S. Pat. No. 3,640,998, Mansfield et al, issued February 1972; U.S. Pat. No. 3,839,318, Mansfield, issued October 1974; and U.S. Pat. No. 4,223,129, Roth et al., issued in September 1980. All of the above patents are incorporated herein by reference.

7. Fatty acid amide surfactants having the formula $$R^6-\overset{\overset{\displaystyle O}{\|}}{C}-NR^7{}_2$$

wherein $R^6$ is an alkyl group containing from about 7 to about 21 (preferably from about 9 to about 17) carbon atoms and each $R^7$ is selected from the group consisting of hydrogen, $C_1$–$C_4$ alkyl, $C_1$–$C_4$ hydroxyalkyl, and $-(C_2H_4)_x$ where x varies from about 1 to about 3.

Preferred amides are $C_8$–$C_{20}$ ammonia amides, monoethanolamides, diethanolamides, and isopropanolamides.

B. Anionic Surfactants

Anionic surfactants suitable for use in the present invention are generally disclosed in U.S. Pat. No. 3,929,678, Laughlin et al, issued Dec. 30, 1975, at column 23, line 58 through column 29, line 23, incorporated herein by reference. Classes of useful anionic surfactants include:

1. Ordinary alkali metal soaps, such as the sodium, potassium, ammonium and alkylolammonium salts of higher fatty acids containing from about 8 to about 24 carbon atoms, preferably from about 10 to about 20 carbon atoms. Preferred alkali metal soaps are sodium laurate, sodium stearate, sodium oleate and potassium palmitate.

2. Water-soluble salts, preferably the alkali metal, ammonium and alkylolammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.)

Examples of this group of anionic surfactants are the sodium and potassium alkyl sulfates, especially those obtained by sulfating the higher alcohols ($C_8$–$C_{18}$ carbon atoms), such as those roduced by reducing the glycerides of tallow or coconut oil; and the sodium and potassium alkylbenzene sulfonates in which the alkyl group contains from about 9 to about 15 carbon atoms, in straight chain or branched chain configuration, e.g., those of the type described in U.S. Pat. No. 2,220,099, Guenther et al, issued Nov. 4, 1940, and U.S. Pat. No. 2,477,383, Lewis, issued Dec. 26, 1946. Especially useful are linear straight chain alkylbenzene sulfonates in which the average number of carbon atoms in the alkyl group is from about 11 to about 13, abbreviated as $C_{11}$–$C_{13}$LAS.

Another group of preferred anionic surfactants of this type are the alkyl polyethoxylate sulfates, particularly those in which the alkyl group contains from about 10 to about 22, preferably from about 12 to about 18 carbon atoms, and wherein the polyethoxylate chain contains from about 1 to about 15 ethoxylate moieties, preferably from about 1 to about 3 ethoxylate moieties.

Other anionic surfactants of this type include sodium alkyl glyceryl ether sulfonates, especially those ethers of higher alcohols derived from tallow and coconut oil; sodium coconut oil fatty acid monoglyceride sulfonates and sulfates; sodium or potassium salts of alkyl phenol ethylene oxide either sulfates containing from about 1 to about 10 units of ethylene oxide per molecule and wherein the alkyl groups contain from about 8 to about 12 carbon atoms; and sodium or potassium salts of alkyl ethylene oxide ether sulfates containing about 1 to about 10 units of ethylene oxide per molecule and wherein the alkyl group contains from about 10 to about 20 carbon atoms.

Also included are water-soluble salts of esters of alpha-sulfonated fatty acids containing from about 6 to about 20 carbon atoms in the fatty acid group and from about 1 to about 10 carbon atoms in the ester group; water-soluble salts of 2-acyloxy-alkane-1-sulfonic acids containing from about 2 to about 9 carbon atoms in the acyl group and from about 9 to about 23 carbon atoms in the alkane moiety; alkyl ether sulfates containing from about 10 to about 20 carbon atoms in the alkyl group and from about 1 to about 30 moles of ethylene oxide; water-soluble salts of olefin sulfonates containing from about 12 to about 24 carbon atoms; and beta-alkyloxy alkane sulfonates containing from about 1 to about 3 carbon atoms in the alkyl group and from about 8 to about 20 carbon atoms in the alkane moiety.

3. Anionic phosphate surfactants.

4. N-alkyl substituted succinamates.

C. Ampholytic Surfactants

Ampholytic surfactants can be broadly described as aliphatic derivatives of secondary or tertiary amines, or aliphatic derivatives of heterocyclic secondary and tertiary amines in which the aliphatic radical can be straight or branched chain and wherein one of the aliphatic substituents contains from about 8 to about 18 carbon atoms and at least one of the aliphatic substituents contains an anionic water-solubilizing group, e.g., carboxy, sulfonate, sulfate. See U.S. Pat. No. 3,929,678, Laughlin et al, issued Dec. 30, 1975, column 19, line 38 through column 22, line 48, incorporated herein by reference, for examples of ampholytic surfactants useful herein.

D. Zwitterionic Surfactants

Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. See U.S. Pat. No. 3,929,678, Laughlin et al, issued Dec. 30, 1975, column 19, line 38 through column 22, line 48, incorporated herein by reference, for examples of zwitterionic surfactants useful herein.

The above listings of exemplary noncationic surfactants are in fact intended to be merely exemplary in nature, and are not meant to limit the scope of the invention. Additional noncationic surfactants useful in the present invention and listings of their commercial sources can be found in McCutcheon's *Detergents and Emulsifiers,* North American Ed. pages 312–317 (1987), incorporated herein by references.

The noncationic surfactant can be applied to tissue paper as it is being made on a papermaking machine or thereafter: either while it is wet (i.e., prior to final drying) or dry (i.e., after final drying). However, it has been found that greater softness benefits are obtained by addition of the noncationic surfactant to a wet web. Without being bound by theory, it is believed that addition of the noncationic surfactant to a wet web allows the surfactant to interact with the tissue before the bonding structure has been completely set, resulting in a softer tissue paper than obtained by treating a dry tissue web with a noncationic surfactant. Preferably, an aqueous mixture containing the noncationic surfactant is sprayed onto the tissue paper as it courses through the papermaking machine: for example, and not by way of limitation, referring to a papermaking machine of the general configuration disclosed in Sanford-Sisson (referenced hereinbefore), either before the predryer, or after the predryer. Addition of the noncationic surfactant to the wet end of the paper machine (i.e., the paper furnish) is impractical due to low retention levels of the surfactant and excessive foaming.

As discussed above, the noncationic surfactant is preferably applied subsequent to formation of the wet web and prior to drying to completion. In a typical process, the web is formed and then dewatered prior to application of the noncationic surfactant in order to reduce the loss of noncationic surfactant due to drainage of free water. The noncationic surfactant is preferably, applied to the wet web at a fiber consistency levels of between 10% and about 80%, more preferably between about 15% and about 35%, in the manufacture of conventionally pressed tissue paper; and to a wet web having a fiber consistency of between about 20% and about 35% in the manufacture of tissue paper in papermaking machines wherein the newly formed web is transferred from a fine mesh Fourdrinier to a relatively coarse imprinting/carrier fabric. This is because it is preferable to make such transfers at sufficiently low fiber consistencies that the fibers have substantial mobility during the transfer; and it is preferred to apply the noncationic surfactant after their mobility has substantially dissipated as water removal progresses through the papermaking machine. Also, addition of the noncationic surfactant at higher fiber consistencies assures greater retention in and on the paper: i.e., less noncationic surfactant is lost in the water being drained from the web to increase its fiber consistency. Surprisingly, retention rates of noncationic surfactant applied to wet webs are high even though the noncationic surfactant is applied under conditions wherein it is not ionically substantive to the fibers. Retention rates in excess of about 90% are expected at the preferred fiber consistencies without the utilization of chemical retention aids.

Methods of applying the noncationic surfactant to the web include spraying and gravure printing. Spraying, has been found to be economical, and susceptible to accurate control over quantity and distribution of noncationic surfactant, so is most preferred. Other methods which are less preferred include deposition of the noncationic surfactant onto a forming wire or fabric which is then contacted by the tissue web; and incorporation of the noncationic surfactant into the furnish prior to web formation. Equipment suitable for spraying noncationic surfactant containing liquids onto wet webs include external mix, air atomizing nozzles such as the 2 mm nozzle available from V.I.B. Systems, Inc., Tucker, Ga. Equipment suitable for printing noncationic surfactant containing liquids onto wet webs includes rotogravure printers.

The noncationic surfactant should be applied uniformly to the wet tissue paper web so that substantially the entire sheet benefits from the tactile effect of noncationic surfactant. Applying the noncationic surfactant to the wet tissue web in continuous and patterned distributions are both within the scope of the invention and meet the above criteria.

Noncationic surfactant can be applied to dry paper webs by the same methods previously discussed with respect to wet paper web noncationic surfactant treatments.

Preferably, as stated hereinbefore, the noncationic surfactant is substantially nonmigratory in situ after the tissue paper has been manufactured in order to substantially obviate post-manufacturing changes in the tissue paper's properties which might otherwise result from the inclusion of noncationic surfactant. This may be achieved, for instance, through the use of noncationic surfactants having melt temperatures greater than the temperatures commonly encountered during storage, shipping, merchandising, and use of tissue paper product embodiments of the invention: for example, melt temperatures of about 50° C. or higher. Also, the noncationic surfactant is preferably water-soluble when applied to the wet web.

It has been found, surprisingly, that low levels of a noncationic surfactant applied to tissue paper structures can provide an enhanced tactile sense of softness without the aid of additional materials such as oils or lotions. Importantly, these benefits can be obtained for many of the embodiments of the present invention in combination with tensile strengths within the ranges desirable for toilet paper application. Preferably, tissue paper treated with noncationic surfactant in accordance with the present invention comprises about 2% or less noncationic surfactant. It is an unexpected benefit of this invention that tissue paper treated with about 2% or less noncationic surfactant can have imparted thereto substantial softness by such a low level of noncationic surfactant.

The level of noncationic surfactant applied to tissue paper to provide the aforementioned softness/tensile benefit ranges from about 0.01% to about 2% noncationic surfactant retained by the tissue paper, more preferably, from about 0.05% to about 1.0% based on the dry fiber weight of the tissue paper.

As stated hereinbefore, it is also desirable to treat noncationic surfactant containing tissue paper with a relatively low level of a binder for lint control and/or to increase tensile strength. As used herein, the term "binder" refers to the various wet and dry strength additives known in the art. Starch has been found to be the preferred binder for use in the present invention. Preferably, the tissue paper is treated with an aqueous solution of starch and, also preferably, the sheet is moist at the time of application. In addition to reducing linting of the finished tissue paper product, low levels of starch also imparts a modest improvement in the tensile strength of tissue paper without imparting boardiness (i.e., stiffness) which would result from additions of high levels of starch. Also, this provides tissue paper having improved strength/softness relationship compared to tissue paper which has been strengthened by traditional methods of increasing tensile strength: for example, sheets having increased tensile strength due to increased refining of the pulp; or through the addition of other dry strength additives. Surprisingly, it has been found that the combination of noncationic surfactant and starch treatments results in greater softness benefits for a given tensile strength level than the softness benefits obtained by treating tissue paper with a noncationic surfactant alone. This result is especially surprising since starch has traditionally been used to build strength at the expense of softness in applications wherein softness is not an important characteristic: for example, paperboard. Additionally, parenthetically, starch has been used as a filler for printing and writing paper to improve surface printability.

In general, suitable starch for practicing the present invention is characterized by water solubility, and hydrophilicity. Exemplary starch materials include corn starch and potato starch, albeit it is not intended to thereby limit the scope of suitable starch materials; and waxy corn starch that is known industrially as amioca starch is particularly preferred. Amioca starch differs from common corn starch in that it is entirely amylopectin, whereas common corn starch contains both amplopectin and amylose. Various unique characteristics of amioca starch are further described in "Amioca—The Starch From Waxy Corn", H. H. Schopmeyer, Food Industries, December 1945, pp. 106–108 (Vol. pp. 1476–1478).

The starch can be in granular or dispersed form, albeit granular form is preferred. The starch is preferably sufficiently cooked to induce swelling of the granules. More preferably, the starch granules are swollen, as by cooking, to a point just prior to dispersion of the starch granule. Such highly swollen starch granules shall be referred to as being "fully cooked." The conditions for dispersion in general can vary depending upon the size of the starch granules, the degree of crystallinity of the granules, and the amount of amylose present. Fully cooked amioca starch, for example, can be prepared by heating an aqueous slurry of about 4% consistency of starch granules at about 190° F. (about 88° C.) for between about 30 and about 40 minutes.

Other exemplary starch materials which may be used include modified cationic starches such as those modified to have nitrogen containing groups such as amino groups and methylol groups attached to nitrogen, available from National Starch and Chemical Company, (Bridgewater, N.J.). Such modified starch materials have heretofore been used primarily as a pulp furnish additive to increase wet and/or dry strength. However when applied in accordance with this invention by application to a wet tissue paper web they may have reduced effect on wet strength relative to wet-end addition of the same modified starch materials. Considering that such modified starch materials are more expensive than unmodified starches, the latter have generally been preferred.

The starch should be applied to the tissue paper while the paper is in a moist condition. The starch based material is added to the tissue paper web, preferably when the web has a fiber consistency of about 80% or less. Noncationic starch materials are sufficiently retained in the web to provide an observable effect on softness at a particular strength level relative to increased refining; and, are preferably applied to wet tissue webs having fiber consistencies between about 10% and about 80%, more preferably, between about 15% and 35%.

Starch is preferably applied to tissue paper webs in an aqueous solution. Methods of application include, the same previously described with reference to application of noncationic surfactant: preferably by spraying; and, less preferably, by printing. The starch may be applied to the tissue paper web simultaneously with, prior to, or subsequent to the addition of noncationic surfactant.

At least an effective amount of starch to provide lint control and concomitant strength increase upon drying relative to a non-starch treated but otherwise identical sheet is preferably applied to the sheet. Preferably, between about 0.01% and about 2.0% of starch is retained in the dried sheet, calculated on a dry fiber weight basis; and, more preferably, between about 0.1% and about 1.0% of starch-based material is retained.

Analysis of the amounts of treatment chemicals herein retained on tissue paper webs can be performed by any method accepted in the applicable art. For example, the level of nonionic surfactants, such as alkylglycosides, retained by the tissue paper can be determined by extraction in an organic solvent followed by gas chromatography to determine the level of surfactant in the extract; the level of anionic surfactants, such as linear alkyl sulfonates, can be determined by water extraction followed by colorimetry analysis of the extract; the level of starch can be determined by amylase digestion of the starch to glucose followed by colorimetry analysis to determine glucose level. These methods are exemplary, and are not meant to exclude other methods which may be useful for determining levels of particular components retained by the tissue paper.

Hydrophilicity of tissue paper refers, in general, to the propensity of the tissue paper to be wetted with water. Hydrophilicity of tissue paper may be somewhat quantified by determining the period of time required for dry tissue paper to become completely wetted with water. This period of time is referred to as "wetting time." In order to provide a consistent and repeatable test for wetting time, the following procedure may be used for wetting time determinations: first, a dry (greater than 90% fiber consistency level) sample unit sheet, approximately $4\frac{3}{8}$ inch$\times 4\frac{3}{4}$ inch (about 11.1 cm$\times$12 cm) of tissue paper structure is provided; second, the sheet is folded into four (4) juxtaposed quarters, and then crumpled into a ball approximately 0.75 inches (about 1.9 cm) to about 1 inch (about 2.5 cm) in diameter; third, the balled sheet is placed on the surface of a body of distilled water at 72° F. (about 22° C.), and a timer is simultaneously started; fourth, the timer is stopped and read when wetting of the balled sheet is completed. Complete wetting is observed visually.

The preferred hydrophilicity of tissue paper depends upon its intended end use. It is desirable for tissue paper used in a variety of applications, e.g., toilet paper, to completely wet in a relatively short period of time to prevent clogging once the toilet is flushed. Preferably, wetting time is 2 minutes or less. More preferably, wetting time is 30 seconds or less. Most preferably, wetting time is 10 seconds or less.

Hydrophilicity characters of tissue paper embodiments of the present invention may, of course, be determined immediately after manufacture. However, substantial increases in hydrophobicity may occur during the first two weeks after the tissue paper is made: i.e., after the paper has aged two (2) weeks following its manufacture. Thus, the above stated wetting times are preferably measured at the end of such two week period. Accordingly, wetting times measured at the end of a two week aging period at room temperature are referred to as "two week wetting times."

The density of tissue paper, as that term is used herein, is the average density calculated as the basis weight of that paper divided by the caliper, with the appropriate unit conversions incorporated therein. Caliper of the tissue paper, as used herein, is the thickness of the paper when subjected to a compressive load of 95 g/in$^2$ (15.5 g/cm$^2$).

The following examples illustrate the practice of the present invention but are not intended to be limiting thereof.

EXAMPLE I

The purpose of this example is to illustrate one method that can be used to make soft tissue paper sheets treated with a noncationic surfactant in accordance with the present invention.

A pilot scale Fourdrinier papermaking machine is used in the practice of the present invention. The paper machine has a layered headbox having a top chamber, a center chamber, and a bottom chamber. Where applicable as indicated in the following examples, the procedure described below also applies to such later examples. Briefly, a first fibrous slurry comprised primarily of short papermaking fibers is pumped through the top and bottom headbox chambers and, simultaneously, a second fibrous slurry comprised primarily of long papermaking fibers is pumped through the center headbox chamber and delivered in superposed relation onto the Fourdrinier wire to form thereon a three-layer embryonic web. The level of mechanical refining of the second fibrous slurry (composed of long papermaking fibers) is increased to offset any tensile strength loss due to the noncationic surfactant treatment. The first slurry has a fiber consistency of about 0.11% and its fibrous content is Eucalyptus Hardwood Kraft. The second slurry has a fiber consistency of about 0.15% and its fibrous content is Northern Softwood Kraft. Dewatering occurs through the Fourdrinier wire and is assisted by a deflector and vacuum boxes. The Fourdrinier wire is of a 5-shed, satin weave configuration having 87 machine-direction and 76 cross-machine-direction monofilaments per inch, respectively. The embryonic wet web is transferred from the Fourdrinier wire, at a fiber consistency of about 22% at the point of transfer, to a carrier fabric having a 5-shed satin weave, 35 machine-direction and 33 cross-machine-direction monofilaments per inch, respectively. The non-fabric side of the web is sprayed with an aqueous solution containing a noncationic suffactant, further described below, by a 2 mm spray nozzle located directly opposite a vacuum dewatering box. The sprayed web is carried on the carrier fabric past the vacuum dewatering box, through blow-through predryers after which the web is transferred onto a Yankee dryer. The other process and machine conditions are listed below. The fiber consistency is about 27% after the vacuum dewatering box and, by the action of the predryers, about 65% prior to transfer onto the Yankee dryer; creping adhesive comprising a 0.25% aqueous solution of polyvinyl alcohol is spray applied by applicators; the fiber consistency is increased to an estimated 99% before dry creping the web with a doctor blade. The doctor blade has a bevel angle of about 24 degrees and is positioned with respect to the Yankee dryer to provide an impact angle of about 83 degrees; the Yankee dryer is operated at about 350° F. (177° C.); the Yankee dryer is operated at abut 800 fpm (feet per minute) (about 244 meters per minute). The dry creped web is then passed between two calender rolls. The two calender rolls are biased together at roll weight and operated at surface speeds of 660 fpm (about 201 meters per minute).

The aqueous solution sprayed through the spray nozzle onto the wet web contains Crodesta TM SL-40 an alkyl glycoside polyester nonionic surfactant. The concentration of the nonionic surfactant in the aqueous solution is adjusted until about 0.15%, based upon the weight of the dry fibers, is retained on the web. The volumetric flow rate of the aqueous solution through the nozzle is about 3 gal./hr.-cross-direction ft (about 37 liters/hr-meter). The retention rate of the nonionic surfactant applied to the web, in general, is about 90%.

The resulting tissue paper has a basis weight of 30g/m$^2$, a density of 0.10 g/cc, and contains 0.15% by weight, of the alkyl glycoside polyester nonionic surfactant.

The resulting tissue paper is highly wettable and has enhanced tactile softness.

EXAMPLE II

The purpose of this example is to illustrate one method that can be used to make soft tissue paper sheets wherein the tissue paper is treated with noncationic surfactant and starch.

A 3-layer paper sheet is produced in accordance with the hereinbefore described process of Example I. The tissue web is, in addition to being treated with a noncationic surfactant as described above, also treated with fully cooked amioca starch prepared as described in the specification. The starch is applied simultaneously with the noncationic surfactant as part of the aqueous solution sprayed through the papermachine spray nozzle. Concentration of the starch in the aqueous solution is adjusted so that the level of amioca starch retained is about 0.2%, based upon the weight of the dry fibers. The resulting tissue paper has a basis weight of 30 g/m$^2$, a density of 0.10 g/cc, and contains 0.15% by weight of Crodesta TM SL-40 nonionic surfactant and 0.2% by weight of the cooked amioca starch. Importantly, the result is a soft tissue sheet having enhanced softness and strength, and lower propensity for lint than the sheet treated only with the noncationic surfactant.

What is claimed is:

1. Tissue paper having a basis weight of from about 10 to about 65 grams per square meter, and density of about 0.6 grams or less per cubic centimeter, said paper comprising cellulosic fibers, an effective amount of an alkyl glycoside surfactant, said effective amount of alkyl glycoside surfactant being from about 0.01% to about 2.0% alkyl glycoside surfactant based on the dry fiber weight of said tissue paper, and an effective amount of a starch binder material, said effective amount of starch being from about 0.01% to about 2.0% based on the dry fiber weight of said tissue paper.

2. The tissue paper of claim 1 wherein said effective amount of alkyl glycoside surfactant is from about 0.05% to about 1.0% alkyl glycoside surfactant based on the dry fiber weight of said tissue paper.

3. The tissue paper of claim 1 wherein said alkyl glycoside surfactant has a melting point of at least about 50° C.

4. The tissue paper of claim 1, 2, or 3 wherein said effective amount of starch is from about 0.1% to about 1.0% based on the dry fiber weight of said tissue paper.

5. The tissue paper of claim 4 wherein said starch is amioco starch.

* * * * *